US007849534B2

(12) United States Patent
Bellick et al.

(10) Patent No.: US 7,849,534 B2
(45) Date of Patent: Dec. 14, 2010

(54) SLEEPING BAG WITH VENTED FOOTBOX

(75) Inventors: Michael M Bellick, Saint Louis, MO (US); Linda S Baugh, Saint Charles, MO (US); John H Wright, Weldon Spring, MO (US); Alain R Denis, Georgetown, TX (US)

(73) Assignee: American Recreation Products, Inc., St. Louis, MO (US)

( * ) Notice: Subject to any disclaimer, the term of this patent is extended or adjusted under 35 U.S.C. 154(b) by 1445 days.

(21) Appl. No.: 10/821,334

(22) Filed: Apr. 9, 2004

(65) Prior Publication Data

US 2005/0034234 A1 Feb. 17, 2005

Related U.S. Application Data

(60) Provisional application No. 60/494,731, filed on Aug. 13, 2003.

(51) Int. Cl.
*A47G 9/08* (2006.01)

(52) U.S. Cl. ..... 5/413 R

(58) Field of Classification Search ..... 5/413 R, 5/482, 486, 413 AM; 2/69.5
See application file for complete search history.

(56) References Cited

U.S. PATENT DOCUMENTS 1,811,821 A * 6/1931 Bloom ..... 2/69
2,093,834 A * 9/1937 Gaugler ..... 4/536
2,234,546 A * 3/1941 Holmes et al. ..... 2/69.5
2,284,900 A 6/1942 Henderson et al.
2,325,305 A * 7/1943 Carlile ..... 24/436
2,341,069 A 2/1944 Anderson
2,578,323 A * 12/1951 Roberts et al. ..... 2/69.5
2,598,462 A * 5/1952 Strauss ..... 2/69.5
2,622,248 A * 12/1952 Schaye ..... 2/80
2,808,596 A * 10/1957 Schreiner ..... 5/486
2,931,373 A * 4/1960 Larson ..... 135/90
2,948,278 A * 8/1960 Topa ..... 128/873
3,787,906 A 1/1974 Hunt
D230,455 S 2/1974 Hunt
3,831,206 A 8/1974 Geary
3,857,125 A 12/1974 Hunt
3,959,834 A 6/1976 Hunt
4,033,001 A 7/1977 Kern
4,072,345 A * 2/1978 Matsuda ..... 297/184.15
4,079,472 A 3/1978 Maguire
4,158,892 A 6/1979 Gonzales (Continued)

FOREIGN PATENT DOCUMENTS

CA 2183114 A1 2/1998

(Continued)

*Primary Examiner*—Michael Safavi
(74) *Attorney, Agent, or Firm*—Senniger Powers LLP

(57) ABSTRACT

A vented sleeping bag comprising an elongate shell defining an inner volume sized and shaped to receive a user therein. The shell has a head end, a foot end, left and right sides extending longitudinally of the shell, an overlying portion which overlies the user, and an underlying portion which underlies the user. The overlying portion of the shell has at least one vent. A closure is selectively movable between a closed position for closing the vent and an open position for creating a vent opening for ventilating the inner volume of the shell.

16 Claims, 4 Drawing Sheets

U.S. PATENT DOCUMENTS 4,308,883 A * 1/1982 Malone ..... 135/90
4,507,805 A 4/1985 Calutoiu
4,531,330 A * 7/1985 Phillips ..... 52/2.21
4,703,521 A * 11/1987 Asher et al. ..... 2/69
4,719,934 A * 1/1988 Mydans ..... 135/90
4,719,935 A * 1/1988 Gustafson ..... 135/124
4,787,105 A * 11/1988 Phillips et al. ..... 5/413 R
4,843,647 A * 7/1989 Phillips, Sr. et al. ..... 2/69
4,884,303 A 12/1989 Scherer
4,887,317 A * 12/1989 Phillips, Sr. et al. ..... 2/458
4,888,828 A 12/1989 Tatsuno
4,894,878 A * 1/1990 Roach ..... 5/413 R
4,989,282 A 2/1991 Goldstein
4,996,733 A * 3/1991 Tsai ..... 5/413 R
5,044,032 A * 9/1991 Tesch ..... 5/502
5,222,257 A 6/1993 Bachor
5,386,602 A 2/1995 Krenzler
5,473,779 A 12/1995 Kramer
5,657,497 A 8/1997 Howe
5,669,088 A 9/1997 McNamee
D405,585 S 2/1999 Stevens
5,881,405 A * 3/1999 Garrigues ..... 5/413 R
5,913,772 A * 6/1999 Clark ..... 5/121
5,960,492 A 10/1999 Byrne
5,966,756 A 10/1999 Cartier
6,018,830 A 2/2000 Howe
6,073,282 A 6/2000 Leeper et al.
6,175,976 B1 1/2001 Cantwell
6,292,961 B1 9/2001 Ganio et al.
6,313,438 B1 * 11/2001 Emerick, Jr. ..... 219/212
6,321,764 B1 * 11/2001 Gauger et al. ..... 135/128
6,353,946 B1 * 3/2002 Steiner ..... 5/121
6,438,774 B1 8/2002 Michaelis et al.
6,449,787 B1 9/2002 Thorne
6,718,577 B2 * 4/2004 Li ..... 5/482
6,799,339 B2 * 10/2004 Stewart ..... 5/413 AM
6,823,678 B1 * 11/2004 Li ..... 62/3.5
6,931,680 B2 * 8/2005 Bellick et al. ..... 5/413 R
6,986,178 B2 * 1/2006 Turner ..... 5/413 R
2004/0173251 A1 * 9/2004 Cantwell ..... 135/115

FOREIGN PATENT DOCUMENTS

GB 2 229 351 A 9/1990

* cited by examiner

SLEEPING BAG WITH VENTED FOOTBOX

CROSS REFERENCE TO RELATED APPLICATION

This application claims the benefit of U.S. Provisional Application No. 60/494,731, filed Aug. 13, 2003, titled SLEEPING BAG WITH VENTED FOOTBOX.

BACKGROUND OF THE INVENTION

This invention relates generally to sleeping bags, and more specifically to a sleeping bag with a vent opening selectively adjustable between an open position and a closed position for venting the inner volume of a sleeping bag.

Consumers face a difficult task in finding a sleeping bag that meets their needs over a wide variety of ambient temperatures in which the bag is intended to be used. Mummy bags, which generally minimize internal volume, are shaped with a lateral taper to approximately contour the body of a person. Accordingly, these bags effectively conserve heat by decreasing air movement within the bag. As a result, mummy-type sleeping bags are well suited for use in outdoor, cold ambient temperatures. A drawback to mummy bags is that some people feel discomfort because they become too warm or the air within the bag becomes stagnant. In addition, the relatively snug fit of these bags reduces the user's range of motion, especially near the foot end of the sleeping bag.

Rectangular-type sleeping bags have a generally constant lateral dimension providing generally good knee and foot room and freedom of motion. While rectangular bags are generally more spacious than mummy bags, a drawback is that their larger internal volumes make them thermally inefficient. As a result, rectangular bags are well suited for use indoors or in milder outdoor temperatures. When used in colder environments, persons using rectangular bags can more easily become chilled, especially toward their feet.

Unfortunately, sleeping bag designs typically incorporate a one-type-fits-all approach. People who want to use bags in both colder and milder temperature environments typically either purchase two bags (i.e., a mummy bag and a rectangular bag) at considerable expense, or get by with one bag designed for one environment but which is less than ideal in the other environment. In addition, some users would prefer a bag that allowed the stagnant air within the bag to escape and be replaced with fresh, ambient air. Unfortunately, no single sleeping bag is available that provides all of these characteristics.

SUMMARY OF THE INVENTION

Among the several objects and features of the present invention may be noted the provision of a sleeping bag for insulated and personal bedding that is adapted for use both indoors and outdoors over a wide range of ambient temperatures; the provision of such a sleeping bag that is adapted for selective ventilation of the inner volume of the sleeping bag; and the provision of such a sleeping bag that is easy to use.

In general, a vented sleeping bag of the present invention comprises an elongate shell defining an inner volume sized and shaped to receive a user therein. The shell has a head end, a foot end and left and right sides extending longitudinally of the shell. In addition, the shell has an overlying portion adapted to overlie a user and an underlying portion adapted to underlie the user. At least one vent is located in the overlying portion of the shell adjacent the foot end of the shell between the left and right sides of the shell. A closure on the shell is selectively movable between a closed position for closing the vent and an open position for creating a vent opening for ventilating the inner volume of the shell.

In another aspect, a vented sleeping bag of the present invention comprises at least one longitudinal vent in the overlying portion of the shell between the left and right sides of the shell and extending longitudinally of the shell. A closure is selectively movable between a closed position for closing the vent and an open position for creating a vent opening for ventilating the inner volume of the shell.

Other objects and features of the present invention will be in part apparent and in part pointed out hereinafter.

DETAILED DESCRIPTION OF THE PREFERRED EMBODIMENTS

Figure 1:
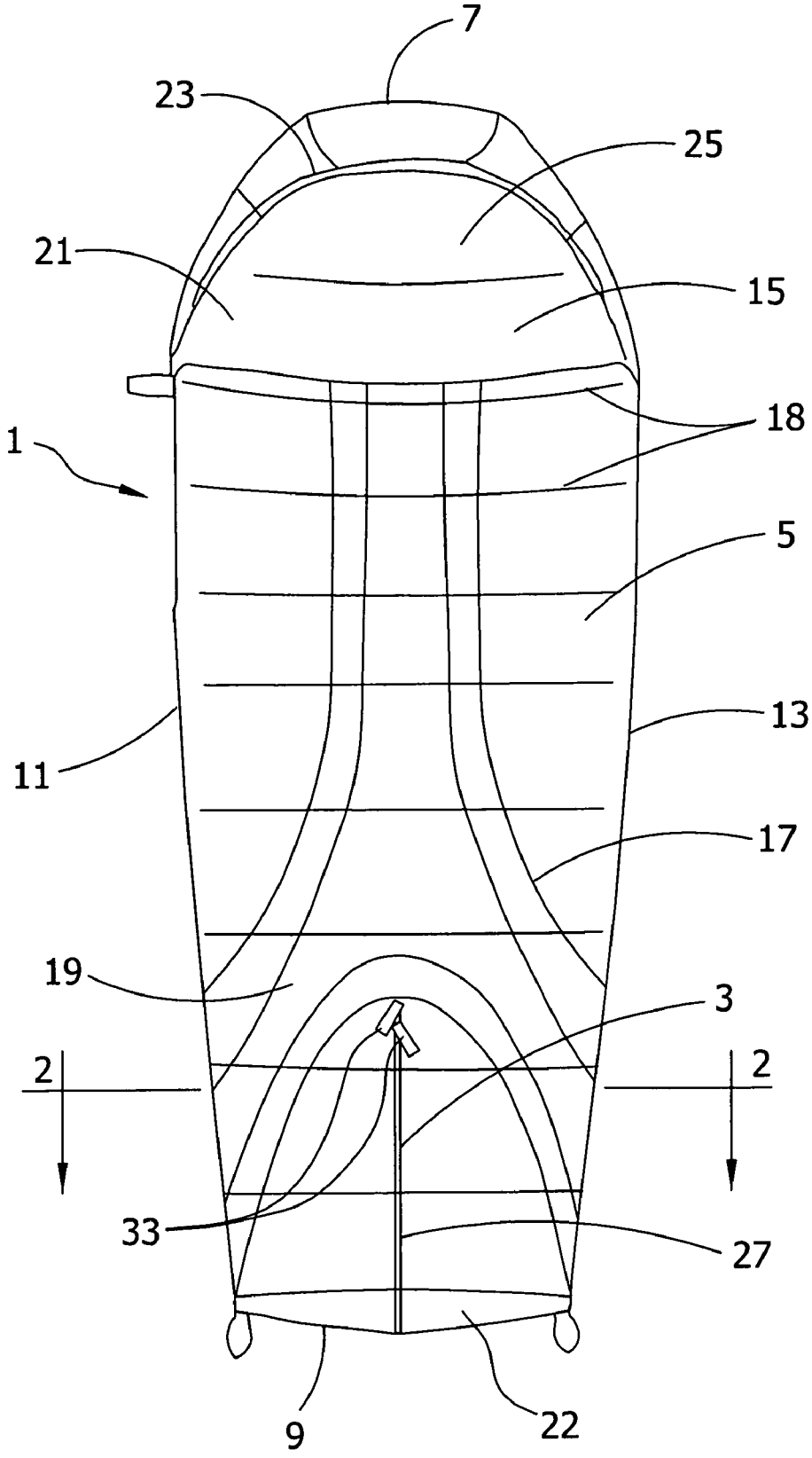
FIG. 1 is a plan view of a sleeping bag of the present invention having a vent which is shown in a closed position.
Figure 3:
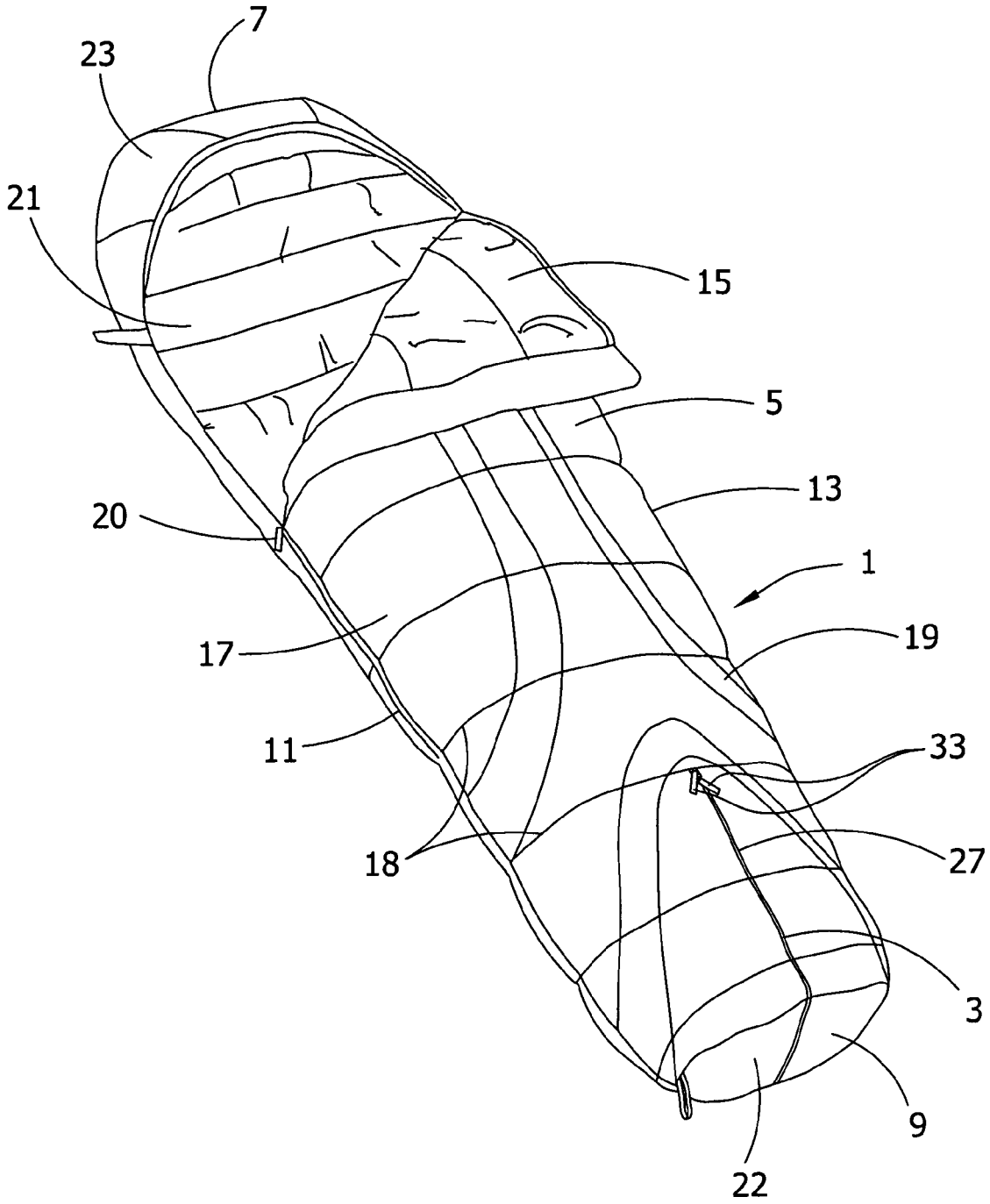
FIG. 3 is a perspective view of the bag.

Referring now to the drawings and in particular to FIGS. 1 and 3, a sleeping bag of the present invention is designated in its entirety by the reference number 1. As will be described hereinafter, the bag 1 has a selectively adjustable vent 3 for ventilating the sleeping bag.

In general, the sleeping bag 1 comprises an elongate shell 5 that defines an inner volume sized and shaped to substantially receive a user therein. The shell 5 has a head end 7, a foot end 9 and right and left sides 11, 13 extending longitudinally of the shell. In one embodiment, the shell 5 is tapered to generally conform to the contours of a user, being broadest in the region corresponding to the shoulders of the user and narrowest in the region corresponding to the feet of the user. By generally conforming to the contours of the user and substantially receiving the user, the air movement within the sleeping bag 1 is minimized thus making the bag thermally efficient. Other shapes are also suitable. For example, the sleeping bag 1 can be generally rectangular in shape.

Figure 2:
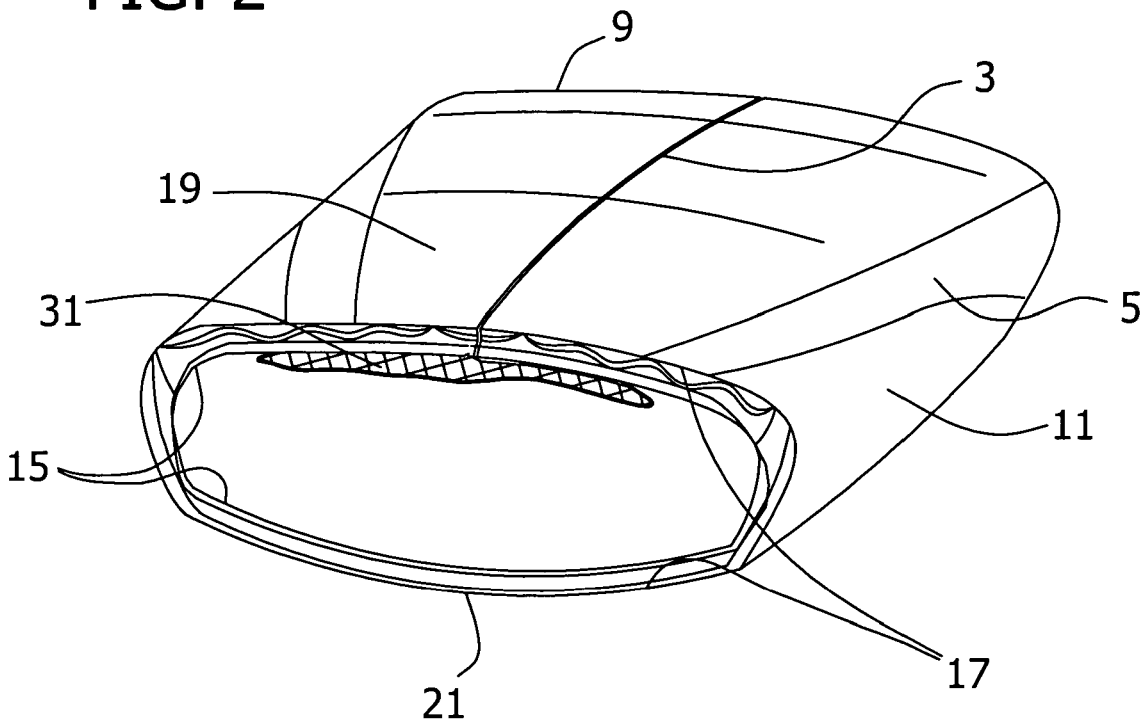
FIG. 2 is a sectional view on line 2-2 of FIG. 1.

The shell 5 comprises an inner layer 15, an outer layer 17 and insulation material (FIG. 2) disposed between the inner and layers. The outer layer 17 of the shell 5 defines the exterior of the shell and has lateral rows of stitching 18 for joining the shell to the internal insulation material. The inner layer 15 covers the inner volume of the shell 5 and is adapted for encompassing a user occupying the sleeping bag 1. The inner and outer layers 15, 17 are stitched together along their periphery edges. The insulation material, which is located between the inner and outer layers 15, 17, provides warmth and softness to the bag 1.

The shell 5 has an overlying portion 19 which overlies the user and an underlying portion 21, which underlies the user, to provide padding between the user and an underlying surface. The overlying and underlying portions 19, 21 are hinged along the left side 13 of the shell 5 and have free edges along at least a portion of the right side 11 of the shell. It is understood that the overlying and underlying portions 19, 21 may be hinged to the right side 11 of the shell 5 and have free edges along the left side 13 of the shell without departing from the scope of this invention. In one embodiment, the free edges of both the overlying and underlying portions 19, 21 extend from the head end 7 of the shell 5 to approximately the transverse centerline. A pair of zipper tracks (not shown) are attached to the shell 5, one track being attached along the free edge of the overlying portion 19 and the other track attached along the free edge of the underlying portion 21. A slide fastener 20 selectively joins the zipper tracks to provide for partial separation of the overlying portion 19 from the underlying portion 21, allowing easy entry and exit by the user.

In one embodiment, the shell 5 has an end panel 22 (FIG. 3) for closing the foot end 9 of the shell. The end panel 22 is stitched into the shell 5 at the foot end 9 between the overlying portion 19 and underlying portion 21. The end panel 22 provides vertical expansion of the shell 5 adjacent the foot end 9 thus adding inner volume to the region which receives the feet of a user. The illustrated sleeping bag also has a hood 23 located at the head end 7 of the shell. The hood 23 is adapted to receive the head of a user to provide warmth. A drawstring (not shown) attached along the periphery of the hood 23 allows the user to selectively open and close the face opening 25.

Figure 4:
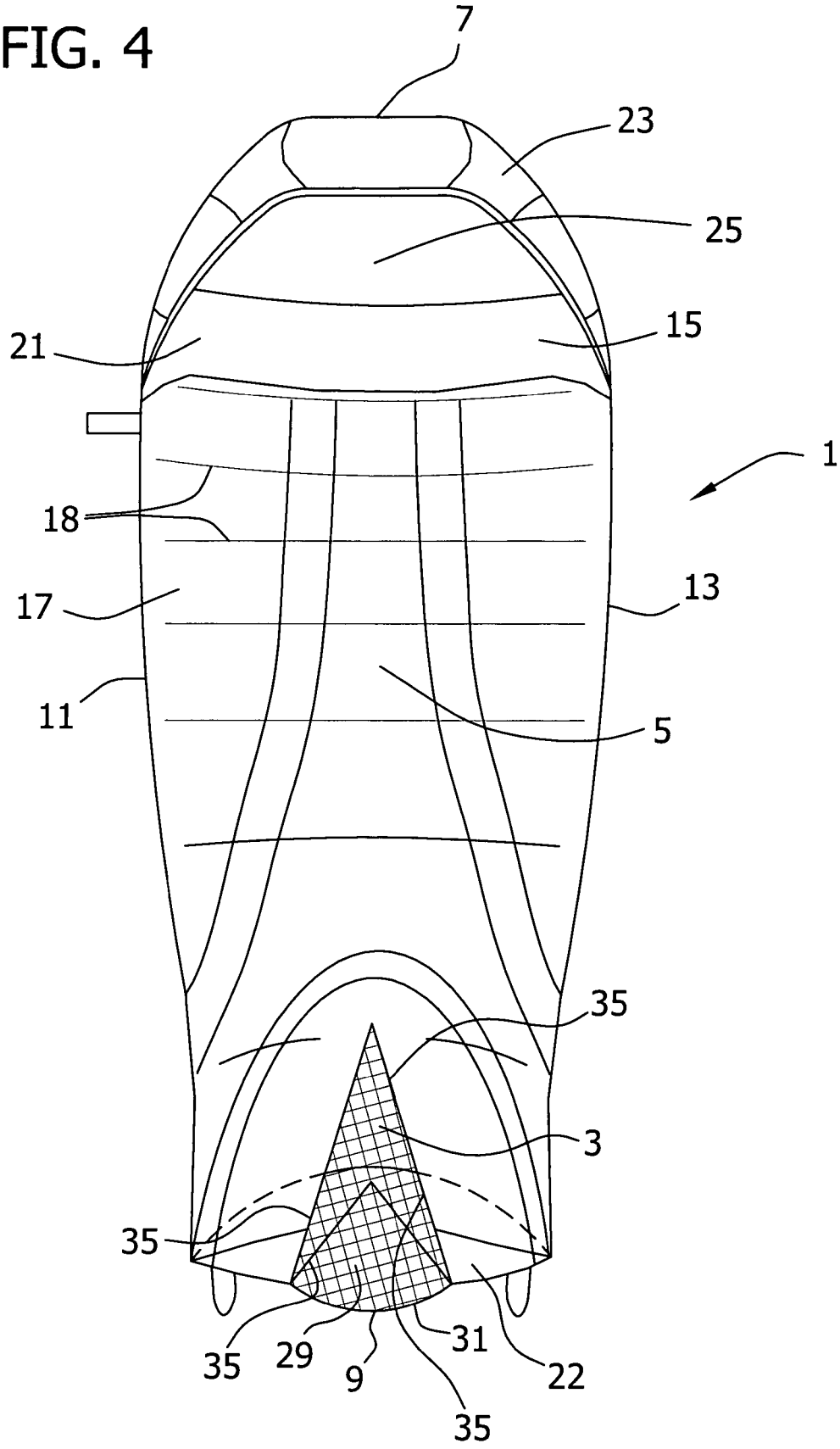
FIG. 4 is a plan view of the sleeping bag with the vent shown in an open position; and Corresponding reference characters indicate corresponding parts throughout the views of the drawings.

In accordance with the present invention, the sleeping bag 1 contains one or more of the aforementioned vents 3 in the overlying portion of the shell 5. Only one such vent 3 is provided in the sleeping bag shown in the drawings, but more than one can be provided. A closure 27 is provided for selectively opening and closing the vent. When the vent 3 is closed (FIG. 1), the sleeping bag 1 provides relatively better warmth by inhibiting air movement within the inner volume. Accordingly, the sleeping bag 1 is well suited for use in colder ambient temperatures. When the vent is open (FIG. 4), a vent opening 29 is created which allows warm stagnant air within the bag 1 to escape and fresh, ambient air to enter the bag. Thus, the sleeping bag 1 is also well suited for use in mild to warm ambient temperatures.

The vent 3 is defined by adjacent edges 35 of the shell 5 which are joined together when the closure is in its closed position (FIG. 1). When the closure is moved to an open position (FIG. 4), the edges 35 of the shell 5 can be separated to create a vent opening 29 of selected size. When the vent 3 is open, the interior volume of the sleeping bag 1 expands to allow greater freedom of movement for user comfort. For example, if the vent 3 is positioned adjacent the foot end 9 of the shell 5, as shown in the illustrated embodiment, moving the closure 27 to open the vent provides greater leg room for the user.

A mesh cover 31 (FIG. 4) is attached to the shell 5, preferably on the inside of the shell adjacent the edges 35 defining the vent 3. When the vent is open, the cover 31 spans (covers) the vent opening 29 to prevent insects and the like from entering the bag 1. The cover also limits the extent to which the edges 35 of the shell defining the vent 3 can be separated. When the vent 3 is closed, the mesh cover 31 collapses within the shell 5. The mesh cover 31 may be attached in any suitable manner to the shell, as by stitching to the inner layer 15 of the shell.

In one embodiment, the closure 27 comprises a pair of zipper tracks extending along the edges 35 of the shell which define the periphery of the opening, and a pair of slide fasteners 33. The use of two slide fasteners 33 allows greater flexibility in selecting the size and position of the vent opening 29. It will be noted in this regard that the size of the vent opening 29 can be adjusted to any size between a fully-open position and fully closed position, depending on user preference. Other types of closures can be used without departing from the scope of this invention.

In the illustrated embodiment, the vent 3 extends longitudinally of the shell approximately midway between the right and left sides 11, 13 of the shell from a location adjacent the foot end 9 of the shell 5 toward the head end 7 of the shell a distance that is in the range of about 10 to 50 percent of the overall length of the shell, and even more preferably approximately one-fourth the length of the shell. Desirably, the vent 3 extends into and across the end panel 22 of the shell 5 toward the underlying portion 21 of the shell. It will be understood that the size, shape and location of the vent (and vent opening) can vary. For example, the vent 3 can run transversely with respect to the longitudinal axis of the shell, or at an oblique angle relative to such axis. Further, the vent can be placed at any location on the shell. Also, a sleeping bag of the present invention may have multiple vents of various shapes and at different locations without departing from the scope of this invention. The vent(s) can extend a shorter or longer distance along the length of the shell than shown in FIGS. 1 and 2.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A vented sleeping bag comprising:

an elongate shell defining an inner volume sized and shaped to receive a user therein, the elongate shell having a head end, a foot end, left and right sides extending longitudinally of the shell, an overlying portion adapted to overlie said user and an underlying portion adapted to underlie said user;

a fastener selectively joining the overlying and underlying portions such that the overlying and underlying portions can be partially separated to allow entry into and exit out of the inner volume of the shell by the user;

at least one vent in said overlying portion of the shell located adjacent the foot end of the shell between the left and right sides of the shell;

a closure selectively movable between a closed position for closing said at least one vent and an open position for creating a vent opening for ventilating the inner volume of the shell; and a mesh cover attached to the shell for covering the vent opening, said mesh cover collapsing within the shell when the at least one vent is closed.

2. The sleeping bag as set forth in claim 1 wherein the at least one vent extends longitudinally of the shell.

3. The sleeping bag as set forth in claim 2 wherein the at least one vent extends longitudinally from generally about the foot end of the shell toward the head end of the shell a distance corresponding to about 10 to 50 percent of the overall length of the shell.

4. The sleeping bag as set forth in claim 3 wherein the at least one vent is about midway between the left and right sides of the shell.

5. The sleeping bag as set forth in claim 1 wherein the shell further comprises an end panel closing the foot end of the shell.

6. The sleeping bag as set forth in claim 5 wherein the at least one vent extends into the end panel of the shell toward the underlying portion of the shell.

7. The sleeping bag as set forth in claim 1 wherein the at least one vent is defined by adjacent edges of the shell, said edges being separable when the closure is in said open position to create said vent opening for ventilating the inner volume of the shell.

8. The sleeping bag as set forth in claim 7 wherein the shell tapers toward the foot end of the shell when the closure is in said closed position, and wherein said edges of the shell defining said vent are separable when the closure is in said open position to expand the said inner volume of the shell adjacent said foot end of the shell.

9. The sleeping bag as set forth in claim 1 wherein the closure comprises a pair of slide fasteners for selectively adjusting the size and position of the vent opening.

10. The sleeping bag as set forth in claim 1 wherein said fastener is a slide fastener.

11. A vented sleeping bag comprising:

an elongate shell defining a inner volume sized and shaped to receive a user therein, the elongate shell having a head end, a foot end, left and right sides extending longitudinally of the shell, an overlying portion adapted to overlie said user, and an underlying portion adapted to underlie said user;

a fastener selectively joining the overlying and underlying portions such that the overlying and underlying portions can be partially separated to allow entry into and exit out of the inner volume of the shell by the user;

at least one longitudinal vent in said overlying portion of the shell located between the left and right sides of the shell and extending longitudinally of the shell;

a closure selectively movable between a closed position for closing said at least one longitudinal vent and an open position for creating a vent opening for ventilating the inner volume of the shell; and a mesh cover attached to the shell for covering the vent opening, said mesh cover collapsing within the shell when the at least one vent is closed.

12. The sleeping bag as set forth in claim 11 wherein the shell further comprises an end panel at the foot end of the shell and wherein the at least one longitudinal vent is partially positioned within the overlying portion and the end panel.

13. The sleeping bag as set forth in claim 11 wherein the at least one longitudinal vent is located about midway between the left and right sides.

14. The sleeping bag as set forth in claim 11 wherein the closure comprises a pair of slide fasteners for selectively adjusting the size and position of the vent opening.

15. The sleeping bag as set forth in claim 11 wherein the at least one longitudinal vent is defined by adjacent edges of the shell, said edges being separable when the closure is in said open position for ventilating the inner volume of the shell.

16. The sleeping bag as set forth in claim 11 wherein said fastener is a slide fastener.

* * * * *